US005555993A

United States Patent [19]

Borkowski et al.

[11] Patent Number: 5,555,993

[45] Date of Patent: Sep. 17, 1996

[54] BEVERAGE CAN AND PIVOTAL, SCREEN GUARD OPENER SYSTEM

[76] Inventors: James T. Borkowski, 5015 Southern Star Ter., Columbia, Md. 21044; Milton F. Borkowski, 12158 Mount Albert Rd., Ellicott City, Md. 21042

[21] Appl. No.: 393,661

[22] Filed: Feb. 24, 1995

[51] Int. Cl.[6] ..... B65D 17/34

[52] U.S. Cl. ..... 220/269; 220/272; 220/713; 220/730; 220/906

[58] Field of Search ..... 220/DIG. 21, 906, 220/713, 719, 711, 704, 712, 729, 730, 724–728, 269, 272, 273, 282

[56] References Cited

U.S. PATENT DOCUMENTS

| | | | |
|---|---|---|---|
| 3,949,898 | 4/1976 | Patel et al. | 220/906 X |
| 4,537,326 | 8/1985 | Morehead | 220/906 X |
| 4,705,186 | 11/1987 | Barrash | 220/269 |
| 4,898,298 | 2/1990 | Norris | 220/711 |
| 4,913,305 | 4/1990 | Hanafusa et al. | 220/269 |
| 4,938,375 | 7/1990 | Fantacone | 220/719 X |
| 5,125,525 | 6/1992 | Tucker | 220/254 |
| 5,269,432 | 12/1993 | Beckertgis | 220/253 |
| 5,379,914 | 1/1995 | Martins | 220/730 X |

*Primary Examiner*—Allan N. Shoap
*Assistant Examiner*—Robin A. Hylton

[57] ABSTRACT

An opener for facilitating opening of a beverage can and precluding an entrance of debris or insects thereinto. The inventive device includes a beverage can having a lid extending across an upper end thereof. A guarded opening assembly is pivotally mounted to the lid and operates to effect fracturing of a frangible opening in the lid. The guarded opening assembly includes a screen positionable over the opening in the lid to preclude an entrance of insects or debris into the can.

2 Claims, 3 Drawing Sheets

FIG 1
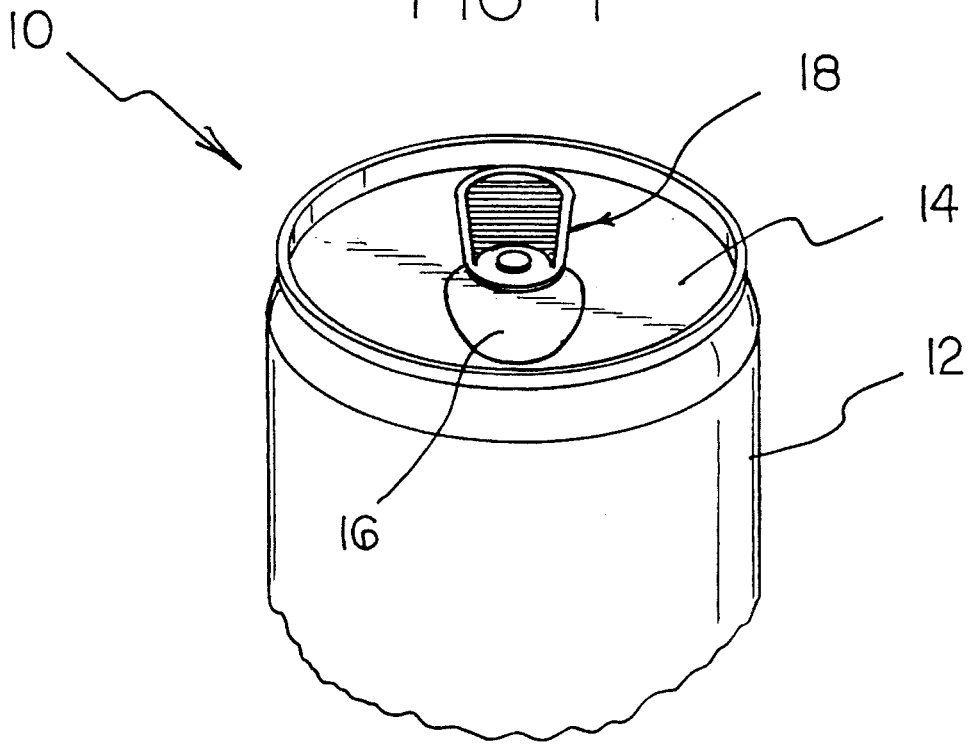
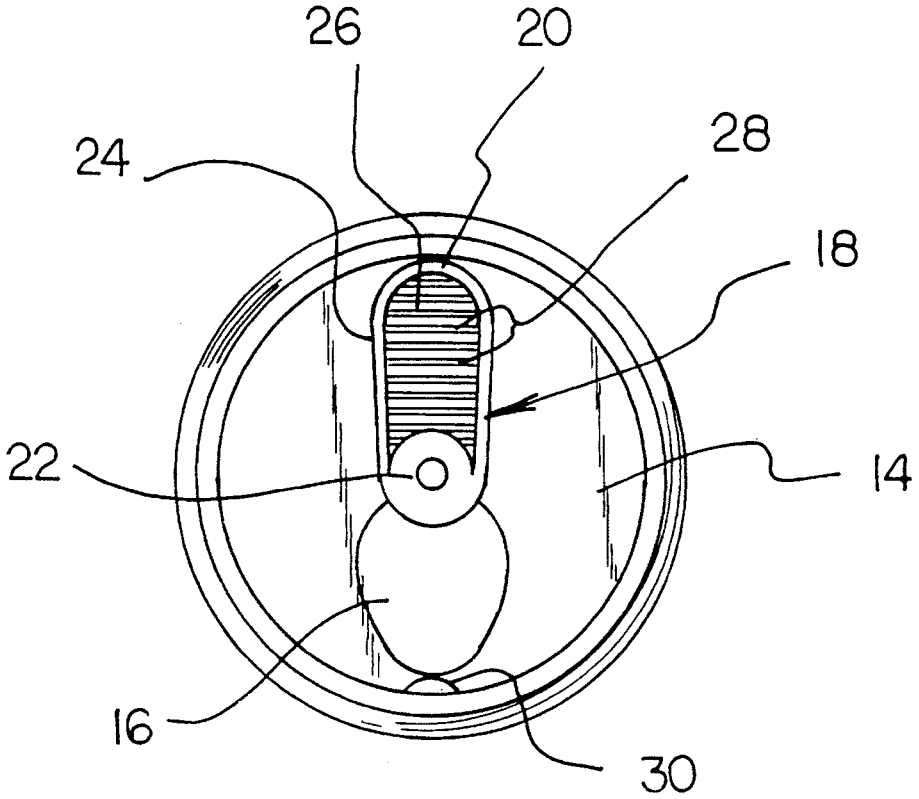
FIG 2

FIG 5
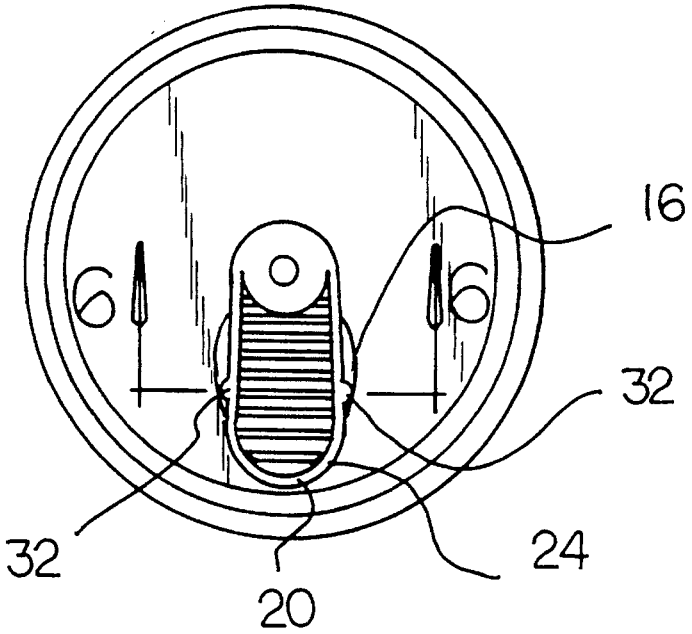
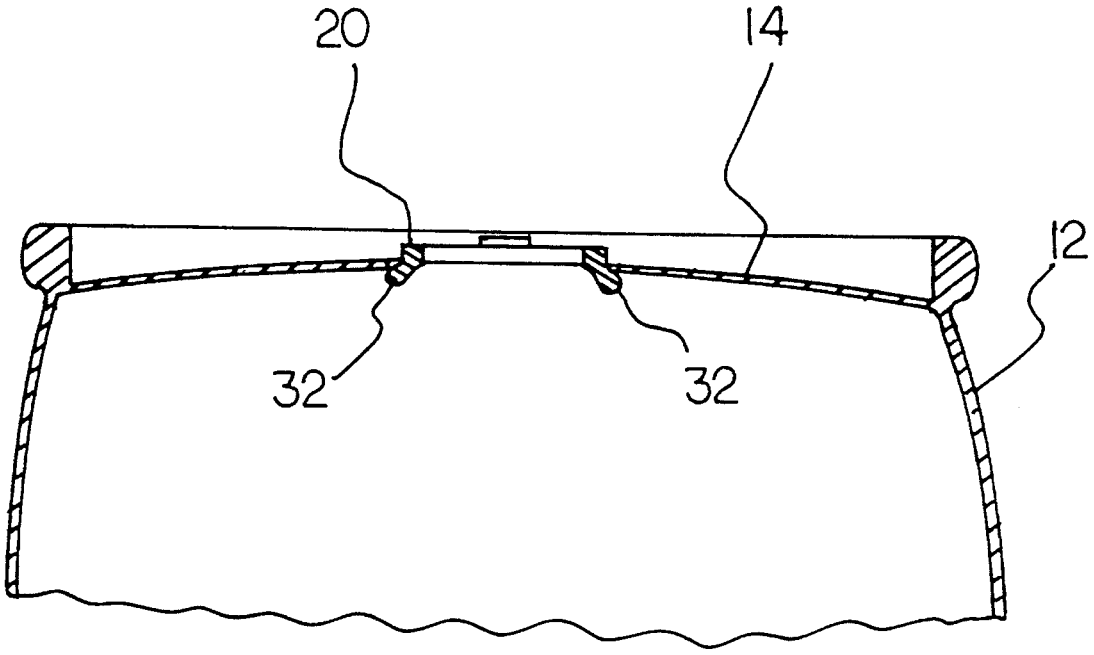
FIG 6

BEVERAGE CAN AND PIVOTAL, SCREEN GUARD OPENER SYSTEM

BACKGROUND OF THE INVENTION

1. Field of the Invention

The present invention relates to container structures and more particularly pertains to a beverage can opener insect screen for facilitating opening of a beverage can and precluding an entrance of debris or insects thereinto.

2. Description of the Prior Art

The use of container structures is known in the prior art. More specifically, container structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art container structures include U.S. Pat. Nos. 5,125,525; 5,269,432; 4,898,298; and 5,102,002.

While these devices fulfill their respective, particular objectives and requirements, the aforementioned patents do not disclose a beverage can opener insect screen for facilitating opening of a beverage can and precluding an entrance of debris or insects thereinto which includes a beverage can having a lid extending across an upper end thereof, and a guarded opening assembly pivotally mounted to the lid and operable to effect fracturing of a frangible opening in the lid, wherein the guarded opening assembly includes a screen positionable over the opening in the lid.

In these respects, the beverage can opener insect screen according to the present invention substantially departs from the conventional concepts and designs of the prior art, and in so doing provides an apparatus primarily developed for the purpose of facilitating opening of a beverage can and precluding an entrance of debris or insects thereinto.

SUMMARY OF THE INVENTION

In view of the foregoing disadvantages inherent in the known types of container structures now present in the prior art, the present invention provides a new beverage can opener insect screen construction wherein the same can be utilized for facilitating opening of a beverage can and precluding an entrance of debris thereinto. As such, the general purpose of the present invention, which will be described subsequently in greater detail, is to provide a new beverage can opener insect screen apparatus and method which has many of the advantages of the container structures mentioned heretofore and many novel features that result in a beverage can opener insect screen which is not anticipated, rendered obvious, suggested, or even implied by any of the prior art container structures, either alone or in any combination thereof.

To attain this, the present invention generally comprises an opener for facilitating opening of a beverage can and precluding an entrance of debris or insects thereinto. The inventive device includes a beverage can having a lid extending across an upper end thereof. A guarded opening assembly is pivotally mounted to the lid and operates to effect fracturing of a frangible opening in the lid. The guarded opening assembly includes a screen positionable over, the opening in the lid to preclude an entrance of insects or debris into the can.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new beverage can opener insect screen apparatus and method which has many of the advantages of the container structures mentioned heretofore and many novel features that result in a beverage can opener insect screen which is not anticipated, rendered obvious, suggested, or even implied by any of the prior art container structures, either alone or in any combination thereof.

It is another object of the present invention to provide a new beverage can opener insect screen which may be easily and efficiently manufactured and marketed.

It is a further object of the present invention to provide a new beverage can opener insect screen which is of a durable and reliable construction.

An even further object of the present invention is to provide a new beverage can opener insect screen which is susceptible of a low cost of manufacture with regard to both materials and labor, and which accordingly is then susceptible of low prices of sale to the consuming public, thereby making such beverage can opener insect screens economically available to the buying public.

Still yet another object of the present invention is to provide a new beverage can opener insect screen which provides in the apparatuses and methods of the prior art some of the advantages thereof, while simultaneously overcoming some of the disadvantages normally associated therewith.

Still another object of the present invention is to provide a new beverage can opener insect screen for facilitating opening of a beverage can and precluding an entrance of debris or insects thereinto.

Yet another object of the present invention is to provide a new beverage can opener insect screen which includes a beverage can having a lid extending across an upper end thereof, and a guarded opening assembly pivotally mounted to the lid and operable to effect fracturing of a frangible opening in the lid, wherein the guarded opening assembly includes a screen positionable over the opening in the lid.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a beverage can opener insect screen according to the present invention.

FIG. 2 is a top plan view thereof.

FIG. 5 is a top plan view of an alternative form of the present invention.

FIG. 6 is a cross-sectional view taken along line 6—6 of FIG. 5.

DESCRIPTION OF THE PREFERRED EMBODIMENT

Figure 3:
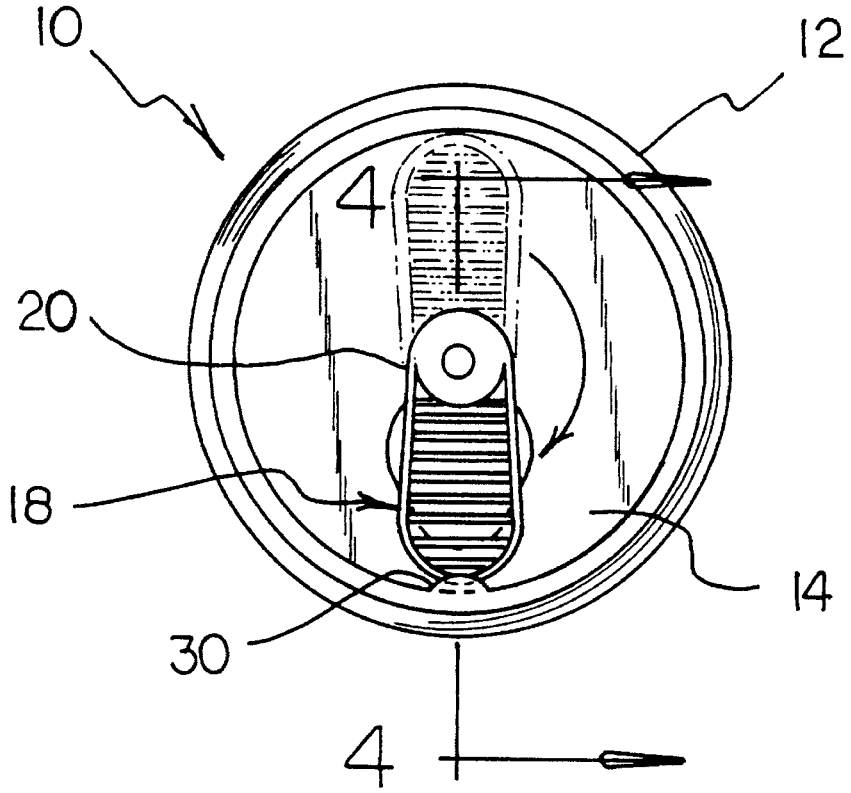
FIG. 3 is a top plan view of the invention illustrating a movement of a guarded opening means relative to a lid of a beverage can.

With reference now to the drawings, and in particular to FIGS. 1–6 thereof, a new beverage can opener insect screen embodying the principles and concepts of the present invention and generally designated by the reference numeral 10 will be described.

More specifically, it will be noted that the beverage can opener insect screen 10 comprises a beverage can 12 having a lid 14 extending across an upper end thereof. The lid 14 is shaped so as to define a frangible opening 16 which can be fractured to permit dispensing of contents from within the beverage can 12 for consumption by an individual. A guarded opening means 18 is pivotally and rotatably mounted to the lid 14 of the beverage can 12 and operates for facilitating opening of the frangible opening 16 and further for precluding an entrance of debris through the frangible opening and into the beverage can 12. By this structure, the guarded opening means 18 can be positioned across the frangible opening 16, whereby contents of the beverage can 12 can be consumed by an individual while an entrance of debris or insects into the beverage can 12 is substantially precluded.

As best illustrated in FIGS. 1 through 4, it can be shown that the guarded opening means 18 according to the present invention 10 preferably comprises a screened opener 20 pivotally and rotatably mounted to a center portion of the lid 14 by an unlabelled fastener extending through the screened opener. Preferably, the unlabelled fastener extending through the screened opener 20 comprises a rivet integrally formed into the lid 14.

With continuing reference to FIG. 2, it can be shown that the screened opener 20 according to the present invention 10 comprises a substantially planar mounting tab 22 through which the unlabelled rivet of the lid 14 projects. A perimeter frame 24 projects from the mounting tab 22 into a substantially elongated shape and is coupled to diametrically opposed portions of the mounting tab 22 substantially as shown. A screen 26 extends across the perimeter frame 24 and can be positioned over the frangible opening 16 through a rotation of the screened opener 20 as illustrated in FIG. 3 to permit drinking of the contents of the beverage can 12 through the frangible opening, while simultaneously precluding an entrance of debris or insects into the beverage can 12. Preferably, the screen 26 of the screened opener 20 comprises a plurality of transverse members 28 extending in a substantially spaced and parallel orientation across the perimeter frame 24. Alternatively, the screen 26 may comprise any type of apertured member sufficient to allow passage of fluid thereacross and to preclude entry of insects and/or debris into the container. Forming of such apertured member may be effected through the slotting or puncturing of holes into a solid member for use as the screen 26.

Figure 4:
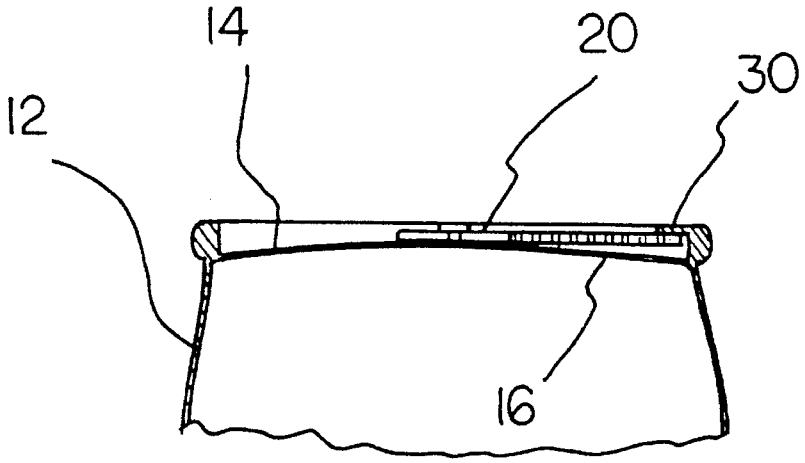
FIG. 4 is a cross-sectional view taken along line 4—4 of FIG. 3.

As best illustrated in FIGS. 3 and 4, the present invention 10 may include a projecting lock tab 30 extending radially inward from an outer periphery of the lid 14 proximal to the frangible opening 16. The lock tab 30 operates to receive a portion of the perimeter frame 24 of the screened opener 20 therebeneath to secure the screened opener 20 in the position illustrated in FIG. 3. By this structure, an unintentional rotation of the screened opener 20 away from the frangible opening 16 is substantially precluded.

Referring now to FIGS. 5 and 6, it can be shown that the present invention 10 may, in lieu of the lock tab 30, alternatively comprise a plurality of depending projections 32 extending from opposed sides of the perimeter frame 24 of the screened opener 20 which cooperatively and resiliently engage opposed sides of the frangible opening 16 of the lid 14 to secure the screened opener thereover. By this structure, an unintentional rotation of the screened opener 20 away from the frangible opening 16 is similarly substantially precluded.

In use, the beverage can opener insect screen 10 according to the present invention can be utilized both to effect fracturing of a frangible opening 16 within a lid 14 of a beverage can 12, as well as to preclude an entrance of debris or insects into the beverage can 12 during consumption of the contents thereof.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A beverage can and pivotal guard opener system comprising:

a beverage can having a central, longitudinal axis and having a lid extending across an upper end thereof, the lid having a frangible opening which can be fractured to permit dispensing of contents from within the beverage can;

said beverage can further having a peripheral wall having a radially inwardly facing surface;

a guarded opening means having a frame thereabout, said guarded opening means being pivotally and rotatably mounted to the lid of the beverage can for facilitating opening of the frangible opening at a first position and further for precluding an entrance of debris through the frangible opening and into the beverage can at a second position; and a lock tab extending radially inward from the inwardly facing surface of said peripheral wall proximal to the frangible opening, wherein the lock tab operates to receive a portion of the frame of the guarded opening means in an axial space provided between the lock tab and the lid to secure the guarded opening means relative to the lid when in said second position.

2. A method of opening a frangible opening of a beverage can, permitting dispensing of fluids from the beverage can, and precluding an entrance of insects and debris into the beverage can, the method comprising:

a beverage can having a central, longitudinal axis and a peripheral wall having a radially inwardly facing surface and a lid extending across an upper end thereof, the lid having a frangible opening which can be fractured to permit dispensing of contents from within the beverage can;

a guarded opening means having a frame, said guard opening means being pivotally and rotatably mounted to the lid of the beverage can for facilitating opening of the frangible opening at a first position and further for precluding an entrance of debris through the frangible opening and into the beverage can at a second position;

pivoting the guarded opening means relative to the can from said first position to effect fracturing of the frangible opening;

rotating the guarded opening means relative to the beverage can to said second position over the fractured frangible opening;

indexing the guarded opening means with a lock tab, said lock tab extending radially inward from the inwardly facing surface of said peripheral wall of the beverage can proximal to the frangible opening; and locking the guarded opening means in an axial space provided between the lock tab and the lid in said second position.

* * * * *